US006568564B2

(12) United States Patent
Wheatley

(10) Patent No.: US 6,568,564 B2
(45) Date of Patent: May 27, 2003

(54) SOFT TUBE DISPENSER APPARATUS

(76) Inventor: Bismark G. Wheatley, 223 Shore Rd., Winter Springs, FL (US) 32708

( * ) Notice: Subject to any disclaimer, the term of this patent is extended or adjusted under 35 U.S.C. 154(b) by 0 days.

(21) Appl. No.: 10/053,359

(22) Filed: Jan. 17, 2002

(65) Prior Publication Data

US 2002/0113085 A1 Aug. 22, 2002

Related U.S. Application Data

(60) Provisional application No. 60/268,947, filed on Feb. 16, 2001.

(51) Int. Cl.[7] ..... B65D 35/34
(52) U.S. Cl. ..... 222/100; 222/410
(58) Field of Search ..... 222/99, 100, 105, 222/106, 410

(56) References Cited

U.S. PATENT DOCUMENTS

| | | | | | |
|---|---|---|---|---|---|
| 1,568,921 | A | | 1/1926 | Roberts | |
| 1,826,189 | A | * | 10/1931 | Rothwell | 222/100 |
| 2,643,795 | A | | 6/1953 | Teal | |
| 2,896,822 | A | * | 7/1959 | Songer | 222/100 |
| 3,920,157 | A | * | 11/1975 | Yeung | 222/100 |
| 4,020,975 | A | | 5/1977 | Stauffer | |
| 4,450,982 | A | | 5/1984 | Ferreira | |
| 5,035,347 | A | | 7/1991 | Trovo | |
| 5,215,223 | A | * | 6/1993 | Lee | 222/100 |
| 5,685,457 | A | * | 11/1997 | Liberatore | 222/100 |
| 6,204,485 | B1 | * | 3/2001 | Williams | 219/429 |

* cited by examiner

*Primary Examiner*—Gene Mancene
*Assistant Examiner*—Melvin A. Cartagena

(57) ABSTRACT

A dispenser apparatus is provided for dispensing the contents of a soft tube, e.g. a toothpaste tube, and includes a base member. A bearing assembly is attached to the base top. A handle assembly includes a manually turnable handle and a reel support axle, and the reel support axle is received in the bearing assembly. A non-slotted end of a reel member is attached to the reel support axle. The reel member includes a tube reception slot. The base member can include a hollow interior filled with a dense, weight ballast material. The base floor can have a bottom exterior surface coated with a non-slip plastic material. A tube supporter member, which includes a tube reception portion, is connected to the base member. The handle and reel member are used to wind the toothpaste tube on the reel member, causing toothpaste to be dispensed from the tube.

8 Claims, 3 Drawing Sheets

SOFT TUBE DISPENSER APPARATUS

CROSS-REFERENCE TO RELATED APPLICATION

This application claims priority based upon my copending Provisional Application Ser. No. 60/268,947; filed Feb. 16, 2001.

BACKGROUND OF THE INVENTION

1. Field of the Invention

The present invention relates generally to toothpaste dispensers, and, more particularly, to devices especially adapted for holding a soft tube that contains toothpaste and for dispensing the toothpaste from the soft tube.

2. Description of the Prior Art

Toothpaste is most commonly packaged in soft tubes, and toothpaste is commonly dispensed from a soft tube by a person manually squeezing the tube. Manual squeezing, however, is often inefficient. The middle of the tube is often squeezed, and a large quantity of toothpaste may be squeezed away from the exit port of the soft tube rather than towards it. Also, when a tube is squeezed and resqueezed numerous times, the material comprising the tube often fatigues and may crack or rupture, thereby permitting toothpaste to be squeezed out from the cracks or ruptures.

To overcome some of these problems associated with manually squeezing soft tubes to dispense toothpaste, throughout the years, a number of innovations have been developed relating to devices for squeezing soft toothpaste tubes to dispense toothpaste therefrom, and the following U.S. patents are representative of some of those innovations: U.S. Pat. Nos. 1,568,921, 2,643,795, 4,450,982, and 5,035,347. More specifically, the devices disclosed in each of U.S. Pat. Nos. 1,568,921, 2,643,795, and 4,450,982 have a common characteristic. That is, a closed end of a soft tube is rotated and formed on a spool, and the spool is translated toward the open end of the soft tube as toothpaste is dispensed from the tube. To provide this translation of the spool towards the open end of the soft tube, a relatively complex device is required. To avoid such complexities, it would be desirable if a soft tube dispenser apparatus were provided which does not cause a spooled end of a soft tube to translate towards the open end of the soft tube as material is dispensed from the soft tube.

U.S. Pat. No. 5,035,347 a dispenser in which the closed end of a soft tube is squeezed to dispense toothpaste from the open end, and the closed end of the tube is not translated towards the open end. However, the closed end of the soft tube is not formed as a spool as the toothpaste is dispensed from the soft tube.

U.S. Pat. No. 4,020,975 may be of interest for its disclosure of a wall-mounted device for dispensing bulk material. A soft tube containing toothpaste is not employed.

Still other features would be desirable in a soft tube dispenser apparatus. Rather than mounting a toothpaste on a vertical surface, such as a wall, it would be desirable to provide a soft tube dispenser apparatus that is supported on a horizontal surface.

Also, as toothpaste is dispensed from a soft tube, it would be desirable if the soft tube is properly oriented with respect to the spool that is formed. In this respect, it would be desirable if a guide would provided to properly orient the soft tube as toothpaste is dispensed from the soft tube.

For dispensing toothpaste from a soft tube, it would be desirable that the dispensing action be smooth and readily controllable, so as not to waste toothpaste or dispense more toothpaste than desired. To provide for a smooth and controllable dispensing action, it would be desirable if a bearing member and a bearing support member were provided for a reel support axle that is attached to a manually turnable handle.

Thus, while the foregoing body of prior art indicates it to be well known to use devices for dispensing toothpaste from a soft tube, the prior art described above does not teach or suggest a soft tube dispenser apparatus which has the following combination of desirable features: (1) does not cause a spooled end of a soft tube to translate towards the open end of the soft tube as material is dispensed from the soft tube; (2) is supported on a horizontal surface; (3) has a guide to properly orient the soft tube as toothpaste is dispensed from the soft tube; and (4) provides a bearing member and a bearing support member for a reel support axle that is attached to a manually turnable handle. The foregoing desired characteristics are provided by the unique soft tube dispenser apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a dispenser apparatus for dispensing the contents of a soft tube and includes a base member which includes a base floor and a base top. A bearing support member is attached to the base top. A bearing member is received in the bearing support member. A handle assembly includes a manually turnable handle and a reel support axle, and the reel support axle is received in the bearing member. A non-slotted end of a reel member is received on the reel support axle. The reel member includes a tube reception slot.

The base member can include a hollow interior filled with a weight ballast material. The weight ballast material is relatively dense material and can be selected from the group consisting of iron, steel, sand, and other suitable dense materials. The base floor can have a bottom exterior surface coated with a non-slip plastic material.

A tube supporter member is connected to the base member. The tube supporter member includes a central tube reception portion. The base member includes a support member reception slot for receiving a bottom end of the tube supporter member.

The handle assembly includes a manually turnable handle, and a reel support axle extending out from the manually turnable handle. The bearing support member and the bearing member have a longitudinal bearing length, and the reel support axle has a longitudinal reel length. The reel support axle is greater than the longitudinal bearing length. The difference between the longitudinal reel length and the longitudinal bearing length defines an exposed reel length. The manually turnable handle is in a form of a disk or thumbwheel.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining a preferred embodiment of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved soft tube dispenser apparatus which has all of the advantages of the prior art and none of the disadvantages.

It is another object of the present invention to provide a new and improved soft tube dispenser apparatus which may be easily and efficiently manufactured and marketed.

It is a further object of the present invention to provide a new and improved soft tube dispenser apparatus which is of durable and reliable construction.

An even further object of the present invention is to provide a new and improved soft tube dispenser apparatus which is susceptible of a low cost of manufacture with regard to both materials and labor, and which accordingly is then susceptible of low prices of sale to the consuming public, thereby making such soft tube dispenser apparatus available to the buying public.

Still yet a further object of the present invention is to provide a new and improved soft tube dispenser apparatus which does not cause a spooled end of a soft tube to translate towards the open end of the soft tube as material is dispensed from the soft tube.

Still another object of the present invention is to provide a new and improved soft tube dispenser apparatus that is supported on a horizontal surface.

Yet another object of the present invention is to provide a new and improved soft tube dispenser apparatus which has a guide to properly orient the soft tube as toothpaste is dispensed from the soft tube.

Even another object of the present invention is to provide a new and improved soft tube dispenser apparatus that provides a bearing member and a bearing support member for a reel support axle that is attached to a manually turnable handle.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein.

DESCRIPTION OF THE PREFERRED EMBODIMENT

Figure 1:
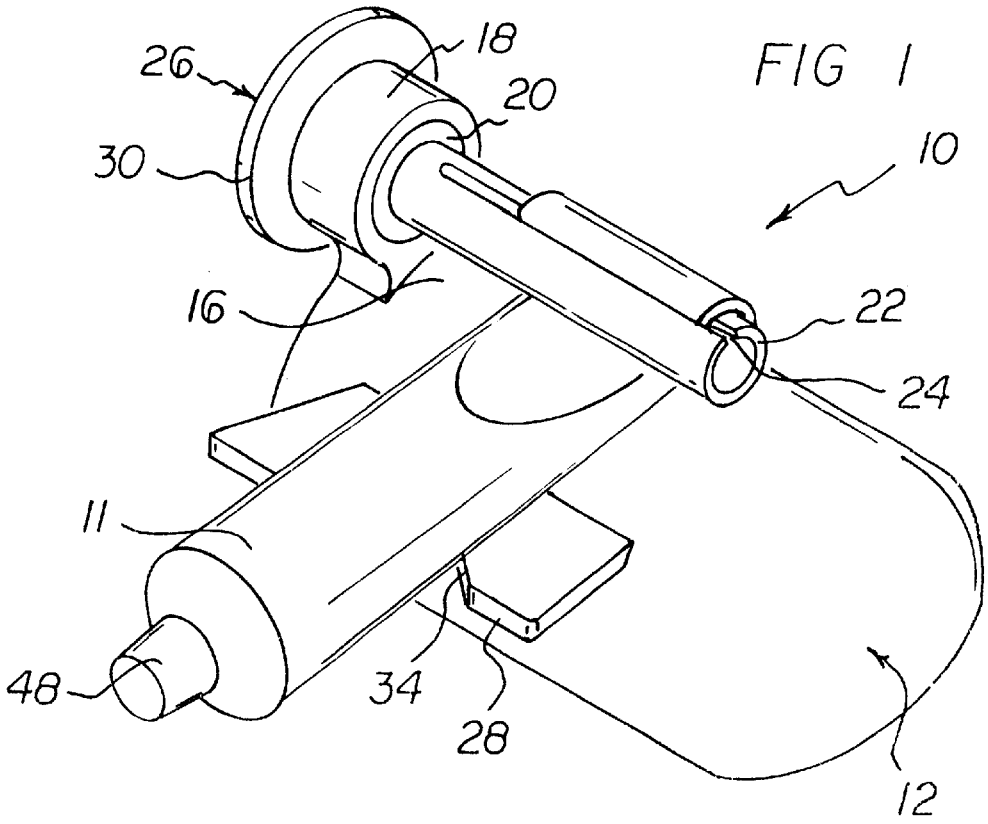
FIG. 1 is a top perspective view showing a preferred embodiment of the soft tube dispenser apparatus of the invention.

With reference to the drawings, a new and improved soft tube dispenser apparatus embodying the principles and concepts of the present invention will be described.

Turning to FIGS. 1–5, there is shown an exemplary embodiment of the soft tube dispenser apparatus of the invention generally designated by reference numeral 10. In its preferred form, dispenser apparatus 10 is provided for dispensing the contents of a soft tube 11 and includes a base member 12 which includes a base floor 14 and a base top 16. A bearing assembly is attached to the base top 16. The bearing assembly can include support member 18 and a bearing member 20 received in the bearing support member 18. A handle assembly 26 includes a manually turnable handle 30 and a reel support axle 32, and the reel support axle 32 is received in the bearing member 20. A non-slotted end of a reel member 22 is received on the reel support axle 32. The reel member includes a tube reception slot.

The base member 12 can include a hollow interior filled with a weight ballast material 13. The weight ballast material 13 is relatively dense material and can be selected from the group consisting of iron, steel, sand, and other suitable dense materials. The base floor 14 can have a bottom exterior surface coated with a non-slip plastic material.

A tube supporter member 28 is connected to the base member 12. The tube supporter member 28 supports the portions of the toothpaste tube 11 that are not supported by the reel member 22. The tube supporter member 28 includes a central tube reception portion 34. The base member 12 includes a support member reception slot 36 for receiving a bottom end of the tube supporter member 28.

The handle assembly 26 includes a manually turnable handle 30, and a reel support axle 32 extending out from the manually turnable handle 30. The bearing support member 18 and the bearing member 20 have a longitudinal bearing length 38, and the reel support axle 32 has a longitudinal reel length 40. The reel support axle 32 is greater than the longitudinal bearing length 38. The difference between the longitudinal reel length 40 and the longitudinal bearing length 38 defines an exposed reel length 42. The manually turnable handle 30 preferably is in the form of a disk suitable to serve as a convenient thumbwheel.

To assemble the dispenser apparatus 10 of the invention, the base member 12 is placed on a support surface, such as the horizontal areas surrounding a concave sink (not shown). The bearing support member 18 is located at one end of the base member 12, and the bearing member 20 is inserted in the bearing support member 18. The reel support axle 32 of the handle assembly 26 is passed through the bearing member 20 towards the opposite end of the base member 12. When the manually turnable handle 30 is adjacent to the bearing support member 18 and the bearing member 20, the reel support axle 32 extends out past the bearing support member 18 and the bearing member 20 by the exposed reel length 42. The non-slotted end 44 of the reel member 22 is pushed onto the exposed reel length 42 and is retained thereon by a friction fit. Then, the bottom end of the tube supporter member 28 is pushed into the support member reception slot 36 in the base member 12 and remains there by a friction fit. At this point, the dispenser apparatus 10 is assembled.

Figure 2:
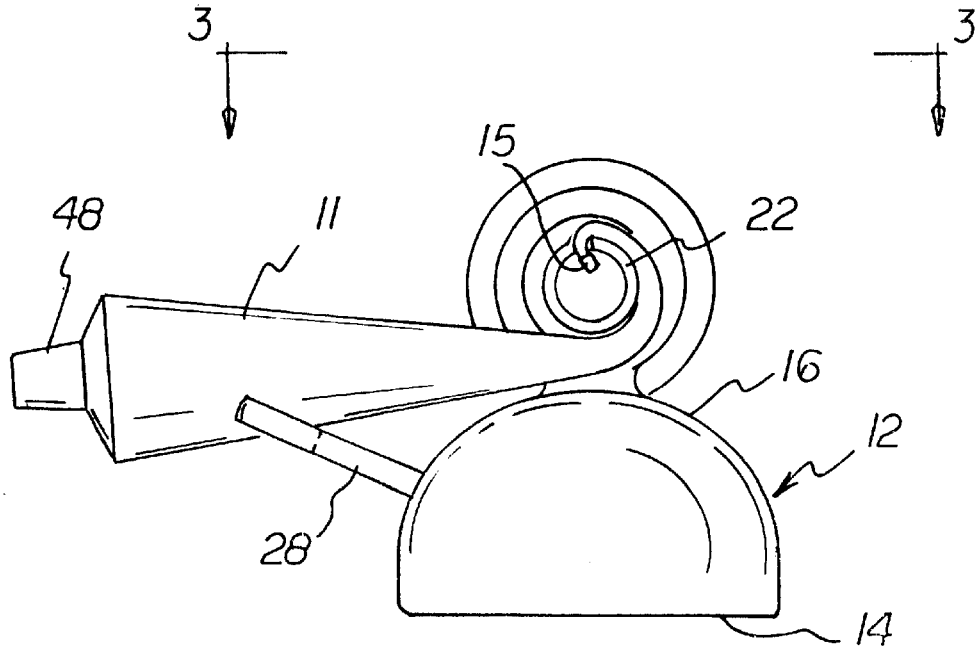
FIG. 2 is a front end view of the embodiment of the soft tube dispenser apparatus shown in FIG. 1.
Figure 3:
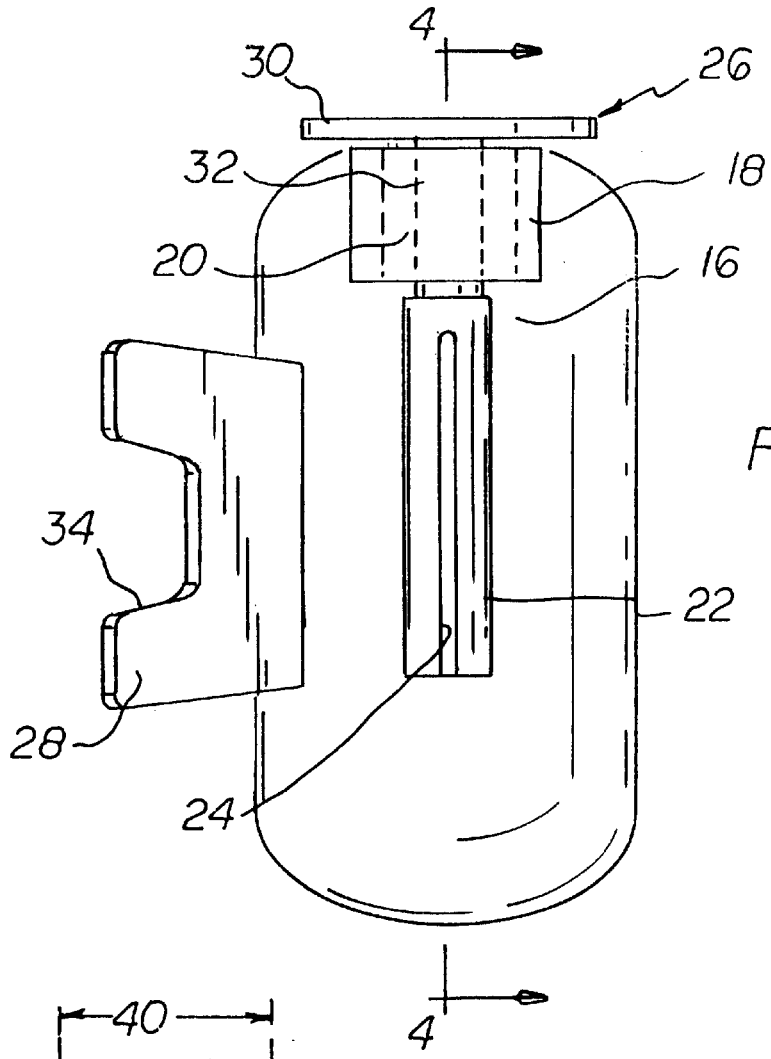
FIG. 3 is a top view of the embodiment of the soft tube dispenser apparatus of FIG. 2 taken along line 3—3 thereof.
Figure 4:
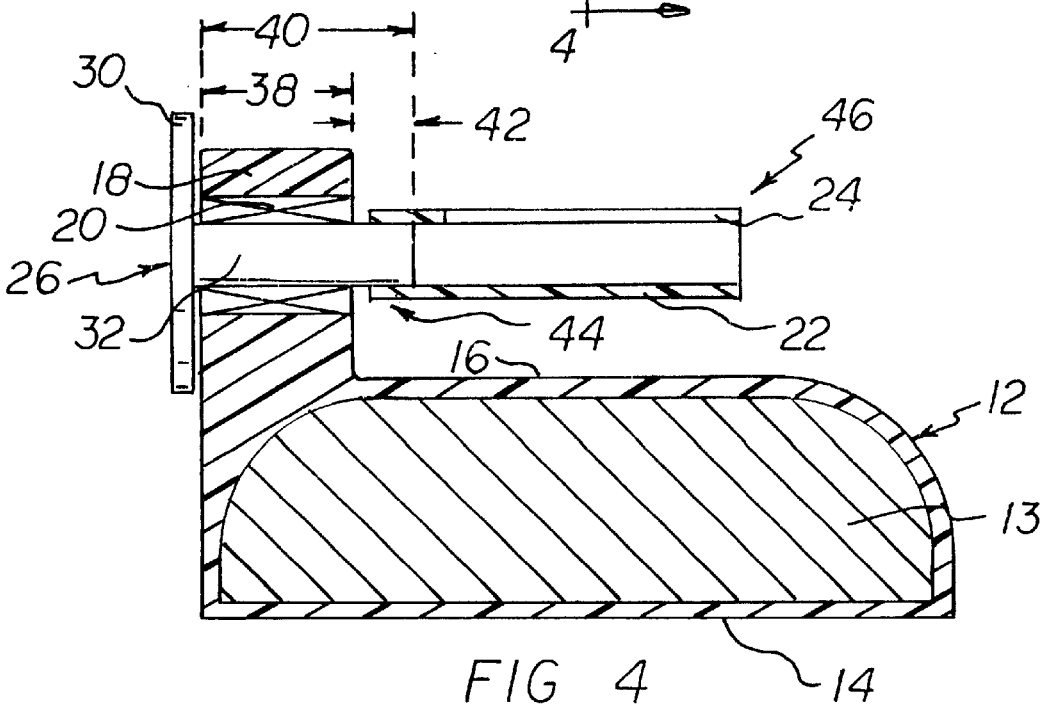
FIG. 4 is a cross-sectional view of the embodiment of the invention shown in FIG. 3 taken along line 4—4 thereof.
Figure 5:
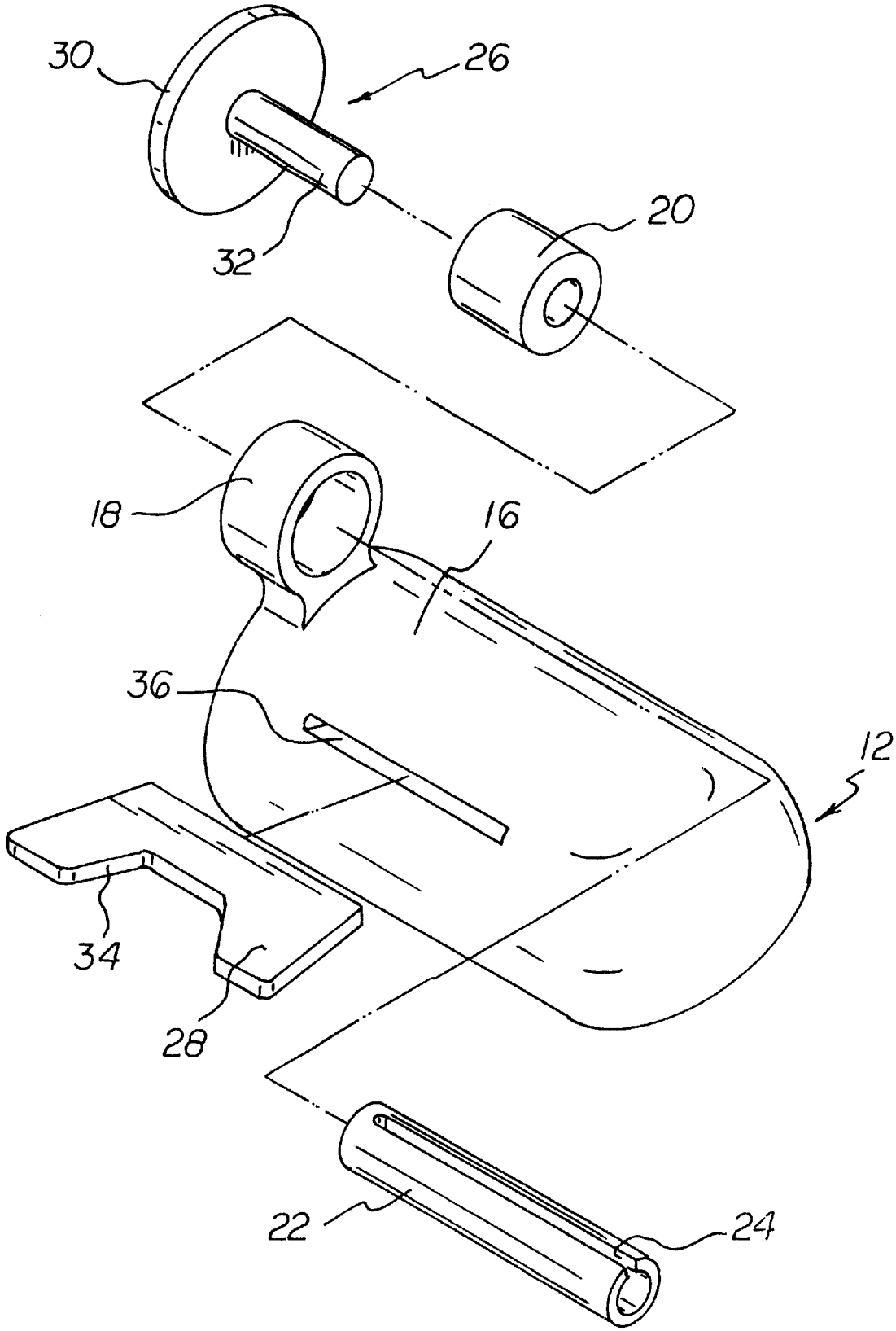
FIG. 5 is an exploded perspective view of the embodiment of the invention shown in FIGS. 1–4.

To use the dispenser apparatus 10, a soft tube, such as a toothpaste tube 11 is obtained. With special reference to FIGS. 1 and 2, the far end 15 of the toothpaste tube 11 is slipped into the tube reception slot 24, and a portion of the body of the toothpaste tube 11 is nested in the tube reception portion 34 of the tube supporter member 28. To dispense toothpaste from the dispenser apparatus 10, the cap 48 is removed from the toothpaste tube 11, and the manually turnable handle 30 is rotated. When this is done, torque force is transmitted from the manually turnable handle 30, through the reel support axle 32, through the reel member 22, and to the end of the toothpaste tube 11. With continued rotation of the manually turnable handle 30, the end of the toothpaste tube 11 is wound around the reel member 22 in a spiral fashion such as shown in FIG. 2. As the toothpaste tube 11 is wound on the reel member 22, the toothpaste inside the toothpaste tube 11 is squeezed out from (dispensed from) the toothpaste tube 11.

When enough toothpaste has been dispensed, the manually turnable handle 30 is no longer turned, and no more toothpaste is dispensed from the toothpaste tube 11. Then, the cap 48 is screwed back onto the toothpaste tube 11 until more toothpaste is needed at a later time.

When a toothpaste tube 11 is fully wound onto the reel member 22, substantially all of the toothpaste has been dispensed from the toothpaste tube 11. The used up toothpaste tube 11 is simply pulled out from the tube reception slot 24 by pulling the used up toothpaste tube 11 in a longitudinal direction away from the manually turnable handle 30. Once the used up toothpaste tube 11 has been removed from the dispenser apparatus 10, a fresh toothpaste tube 11 can be installed in the tube reception slot 24 as described above.

The components of the soft tube dispenser apparatus of the invention can be made from inexpensive and durable metal and plastic materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved soft tube dispenser apparatus that is low in cost, relatively simple in design and operation, and which does not cause a spooled end of a soft tube to translate towards the open end of the soft tube as material is dispensed from the soft tube. With the invention, a soft tube dispenser apparatus is provided which is supported on a horizontal surface. With the invention, a soft tube dispenser apparatus is provided which has a guide to properly orient the soft tube as toothpaste is dispensed from the soft tube. With the invention, a soft tube dispenser apparatus provides a bearing member and a bearing support member for a reel support axle that is attached to a manually turnable handle.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as to encompass all such modifications as well as all relationships equivalent to those illustrated in the drawings and described in the specification.

What is claimed as being new and desired to be protected by Letters Patent of the United States is as follows:

1. A dispenser apparatus for dispensing the contents of a soft tube, comprising:

a base member which includes a base floor and a base top, a bearing assembly attached to a riser portion extending upwardly from said base top, a handle assembly supported by said bearing assembly, and a reel member connected to said handle assembly for engaging one end of said tube in order to dispense contents therefrom, said apparatus further including a tube supporter member connected to said base top, wherein said tube supporter member includes a central tube reception portion, and wherein said handle assembly includes:

a manually turnable handle, and a reel support axle extending from said manually turnable handle and said riser portion in such a manner as to define a reel rotation axis spaced above said base top in generally parallel disposition thereto, and wherein said support member extends at an angle to said reel rotation axis such that said tube may be positioned in said central tube reception portion on said support member in a substantially horizontal orientation relative to said reel member when said one end of said tube engages said reel member.

2. The apparatus of claim 1 wherein said bearing assembly includes:

a bearing support member attached to said riser portion extending upwardly from said base top, a bearing member received in said bearing support member.

3. The apparatus of claim 1 wherein said base floor has a bottom exterior surface coated with a non-slip material.

4. The apparatus of claim 3 wherein said non-slip material is a plastic material.

5. The apparatus of claim 1 wherein said reel member includes a non-slotted end and a slotted end.

6. The apparatus of claim 1 wherein:

said bearing support member and said bearing member have a longitudinal bearing length, and said reel support axle has a longitudinal reel length, and said reel support axle is greater than said longitudinal bearing length.

7. The apparatus of claim 6 wherein the difference between said longitudinal reel length and said longitudinal bearing length defines an exposed reel length.

8. The apparatus of claim 1 wherein said manually turnable handle is in a form of a rotatable disk.

* * * * *